US006571677B1

(12) United States Patent
Kaura

(10) Patent No.: US 6,571,677 B1
(45) Date of Patent: Jun. 3, 2003

(54) BALLISTIC PROTECTIVE PLATE

(76) Inventor: Kamaljit S. Kaura, 22991 La Cadena Dr., Laguna Hills, CA (US) 92653-1314

( * ) Notice: Subject to any disclaimer, the term of this patent is extended or adjusted under 35 U.S.C. 154(b) by 0 days.

(21) Appl. No.: 10/071,121

(22) Filed: Feb. 8, 2002

(51) Int. Cl.[7] ..... F41H 5/04
(52) U.S. Cl. ..... 89/36.02; 109/49.5
(58) Field of Search ..... 89/36.02; 428/911; 109/49.5

(56) References Cited

U.S. PATENT DOCUMENTS 2,758,952 A * 8/1956 Toulmin, Jr.
3,264,165 A * 8/1966 Stickel
3,958,276 A * 5/1976 Clausen ..... 2/2.5
4,633,756 A * 1/1987 Rudoi ..... 89/36.02
4,660,223 A * 4/1987 Fritch ..... 428/911

FOREIGN PATENT DOCUMENTS

DE 35 08 848 A1 * 9/1986 ..... 89/36.02
FR 525818 * 6/1921 ..... 89/36.02

* cited by examiner

*Primary Examiner*—Stephen M. Johnson
(74) *Attorney, Agent, or Firm*—Gene Scott-Patent Law Venture Group

(57) ABSTRACT

A ballistic panel comprises a monolithic epoxy bonded plate made up of laminated individual panels integrally encased within a composite plastic outer shell. At least one of the individual panels is comprised of an integral laminated stack of individual layers of composite and metal construction. An outer layer of composite plastic is used to enclose the structure. The panel achieves high strength, light weight and low cost in construction.

1 Claim, 4 Drawing Sheets

BALLISTIC CHART

NIJ STD 0101.03

NIJ TEST ROUNDS

| Threat Level | Bullet Type | Length Barrel | Velocity | |
|---|---|---|---|---|
| | | | FPS | MPS |
| Level IIA | .357 Magnum 158 Grain JSP | 4" | 1250 | 381 |
| Level II | 9mm 124 Grain FMJ | 4" | 1090 | 332 |
| | .357 Magnum 158 Grain JSP | 6" | 1395 | 425 |
| | 9mm 124 Grain FMJ | 5" | 1175 | 358 |
| Level IIIA | .44 Magnum 240 Grain SWC GC | 6" | 1400 | 427 |
| | 9mm 124 Grain FMJ | 9.5" | 1400 | 427 |
| Level III | 7.62mm NATO BALL 15 Grain M-80 FMJ | 28" | 2750 | 838 |
| Level IV | 30.06 A.P. M-2 | 26" | 2850 | 868 |

*Fig. 7*

BALLISTIC PROTECTIVE PLATE

BACKGROUND OF THE INVENTION

1. Field of the Invention

This invention relates generally to armor plate structures and more particularly to a relatively light weight armor plate with low cost of fabrication and high resistance to projectile impact.

2. Description of Related Art

Ballistic panels are the single most important protection against various forms of ammunition and other projectile threats to law enforcement and armed forces personnel. Such panels are designed to provide protection with respect to the specifications of the National Institute of Justice (NIJ), the body establishing standards in this field, from their specified level IIA to level IV, and other applications such as bomb protection, blast protection and for fighting vehicles. Please see FIG. 7 for a definition of these standards. As stated, these panels are the most critical piece of armor used in law enforcement and military situations. These panels, in various configurations provide protection against variable threats encountered during combat and other situations. The major drawbacks of ballistic materials such as Spectra®, Kevlar®, and armor plate, which are currently in widespread use, are: excessive weight, high cost, and certain limitations to the protection afforded.

The prior art teaches the use of armor panels but does not teach a light weight and low cost panel fabricated using a large number of individual, foil thickness layers. The present invention fulfills these needs and provides further related advantages as described in the following summary.

SUMMARY OF THE INVENTION

The present invention teaches certain benefits in construction and use which give rise to the objectives described below.

The present invention proposes a totally new concept that involves incorporation of several materials in various thickness and layering to maximize protection with minimal weight and cost. This concept utilizes laminated layers forming panels constructed of the following material types:

- Composite material, carbon fiber, layered with composite plastic fibers.
- High carbon alloy steel in various thickness tempered by heat treating by oil quenching to achieve optimal hardness for ballistic applications.
- Kevlar composite material.
- Alloys of tempered armor screen in various thickness so as to provide good ballistic protection through the support of adjacent layers.
- Kevlar fine filaments in a cross-layer configuration.

During extensive trials it was found that a plurality of materials of certain types and at relatively thin structure, i.e., foils, could react in a manner that was surprising in its ability to stop high speed projectiles such as bullets traveling at up to 2850 feet per second. Two different plate configurations have been found to provide outstanding and superior results. These are as follows:

Configuration 1

In this approach, a selected number of panels are used to provide protection against different threat levels. For example, in order to provide NIJ Level III protection; see FIG. 7, a stack of five panels are bonded together. Each of the panels comprises five layers for a combined total of 25 unique layers. This concept provides protection against different threat levels by simply bonding a different number of panels with a thin layer of ballistic epoxy under vacuum conditions and cured at a high temperature. This process eliminates air bubbles, minimizes the thickness and provides an excellent ballistic projective rejection property. Because the number of panels used may be customized to the threat level, this approach provides adequate protection at least cost and weight.

Configuration 2

This approach is similar to configuration 1 except a titanium alloy plate of a selected thickness is incorporated in the stack of panels. The Titanium alloy is heat treated in a controlled inert atmosphere to achieve excellent ballistic properties. The Titanium alloy plate is layered with a chosen number of other panels of materials drawn from the above list.

The typical panel formed in this way may take different shapes or configurations to suit various applications. An eight by ten inch rectangular panel can be formed with a large radius for insertion into a pocket of a bullet proof jacket at its front or rear panel to provide protection up to level IV. Similarly large panels can be formed and mounted under a helicopter pilot or passenger seat to provide protection against ballistic objects. Panels can also be used to reinforce aircraft cockpit doors, buildings, containers, fighting vehicles, cars, podiums, and very many other applications.

A primary objective of the present invention is to provide an apparatus and method of use of such apparatus that provides advantages not taught by the prior art.

Another objective is to provide such an invention capable of rejecting penetration by high speed projectiles.

A further objective is to provide such an invention capable of being made with low weight factor.

A still further objective is to provide such an invention capable of being made at relatively low cost.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings:

FIG. 7 is a chart defining NIJ standard 0101.03.

DETAILED DESCRIPTION OF THE INVENTION

The above described drawing figures illustrate the invention in at least one of its preferred embodiments, which is further defined in detail in the following description.

Figure 1:
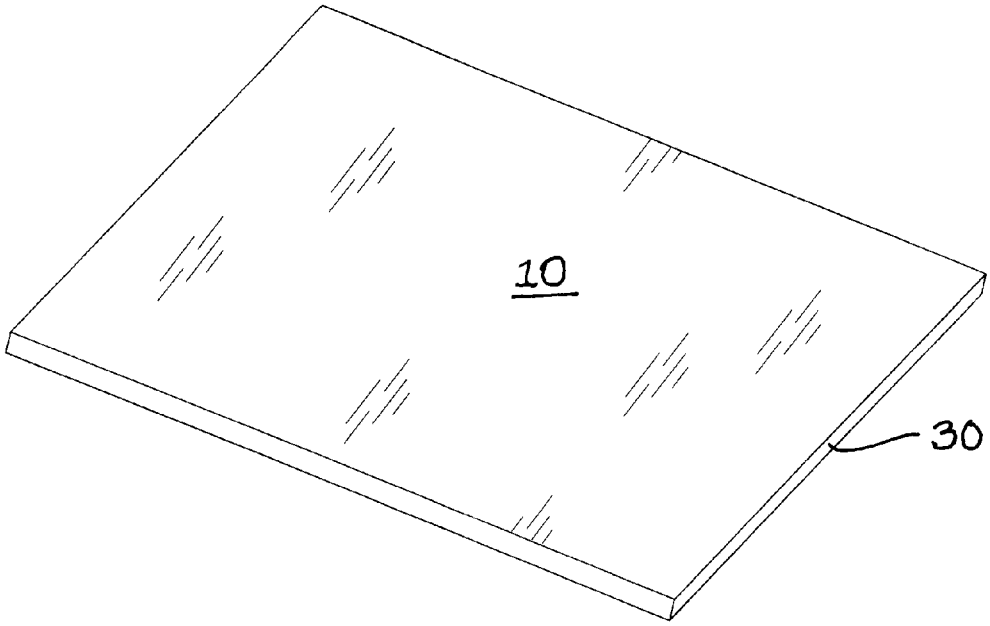
FIG. 1 is a perspective view of a preferred embodiment of the invention.
Figure 2:
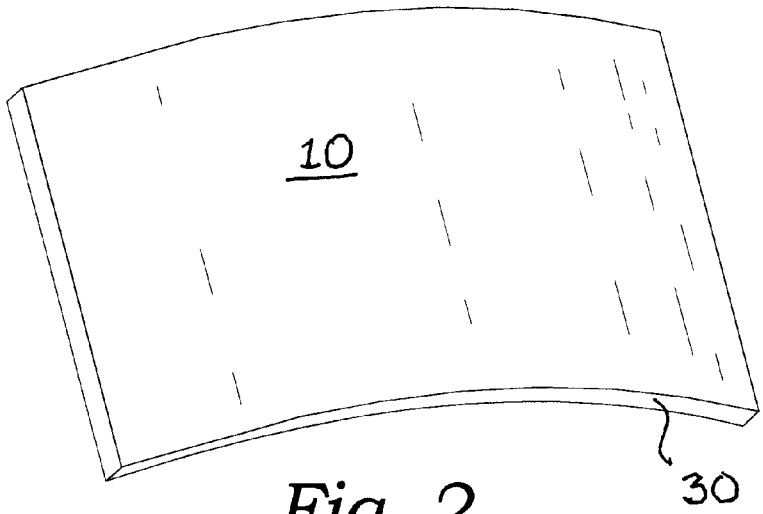
FIG. 2 is a perspective view of an alternate embodiment of the invention.

The present invention is a ballistic protective apparatus comprising a monolithic, indivisible plate; see FIGS. 1 and 2, having a front surface 10, a rear surface 20 and a peripheral edge 30, the peripheral edge 30 defining a thickness of the plate. The plate comprises a laminated assembly of plural individual panels 50 integrally encased within a composite plastic outer shell 60 as shown in the cross sectional views of FIGS. 3 and 4. At least one of the individual panels 50, and preferably all or most of them, are comprised of an integral laminated stack of individual layers 70 bonded together. Preferably, the outer shell 60 is woven of a polyethylene composite thread such as the well-known Kevlar® produced by the Dupont company or Spectra® composite material produced by Allied Signal Corp., or of a combination of these two materials.

Figure 3:
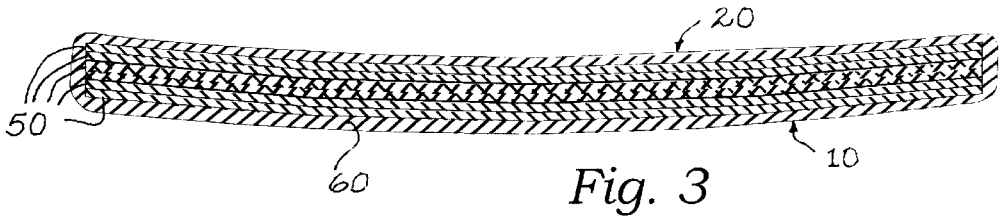
FIGS. 3 and 4 are cross sectional views of preferred structures of the invention.
Figure 4:
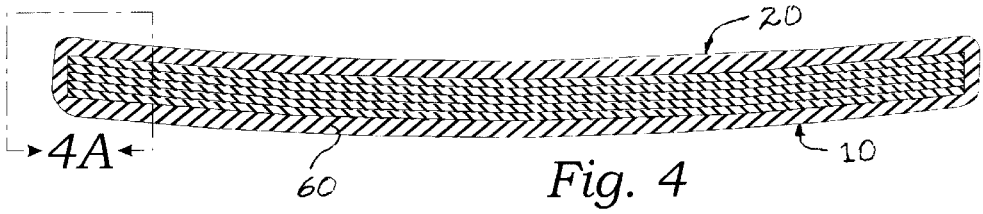
Figure 4A:
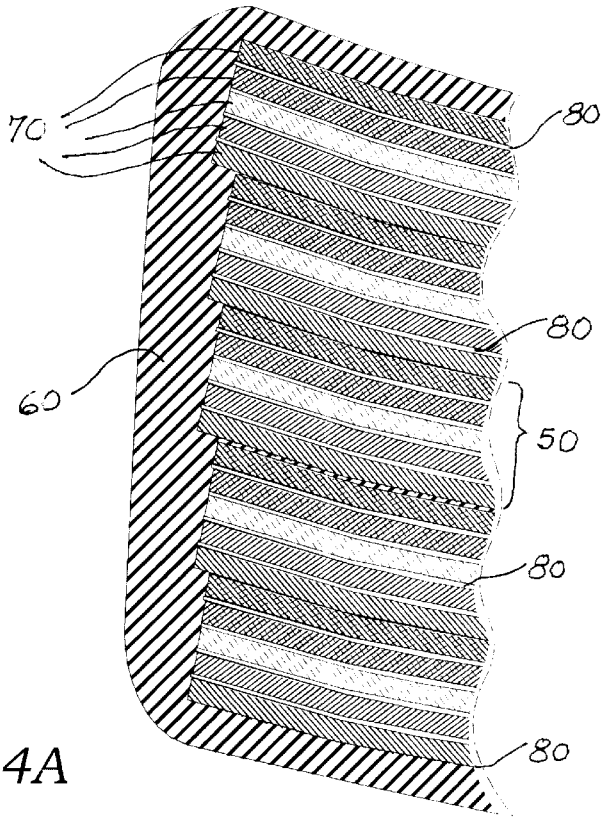
FIG. 4A is an enlarged view taken from FIG. 4.

Preferably, at least one of the individual panels 50 is made of a tempered steel alloy or of a titanium alloy. This configuration is shown in FIG. 3, where the central panel is made of such metal.

Preferably, at least one of the stack of individual layers 70 comprises a composite material, a tempered steel alloy, the composite material, a tempered armor screen, and the composite material, and these layers are preferably ordered as stated as this particular order of the plate has been discovered to provide superior and surprising results. However, the layers may be applied in any order including plural layers of the same material to achieve different results or for different applications with respect to the NIJ specification. The individual layers are bonded with epoxy resin to form each of the multi-layer panels. Such layers are preferably between 0.020 and 0.125 inches in thickness as this range has been discovered through extensive testing, to provide superior ballistic performance to weight ratio.

Preferably, the individual panels 50 and the individual layers are laminated using an epoxy resin 80 under partial vacuum and at elevated temperature, as is well know in the art. The epoxy resin is of a type that is capable of non-crystallization under high instantaneous heat rise so as to maintain structural integrity in the present application.

Such epoxies are well known in the art, but use in laminated structures for ballistic applications is not. The inventive improvement over the prior art ballistic defensive devices of similar size and utilization is quite significant. This benefit is founded on the fact that we have discovered that when a series, or stack of panels of the type described, are bonded together, the shock loading of the plate or trauma, i.e., the ability of the plate to deform locally without such deformation extending through the entire plate structure along the axis of the ballistic projectile.

In one embodiment the plate is flat as shown in FIG. 1, while in an alternate embodiment, the plate is concave about an axis, preferably, when the plate is held vertically, its vertical longitudinal axis aligned with an edge of the rigid plate, as shown in FIG. 2.

Figure 5:
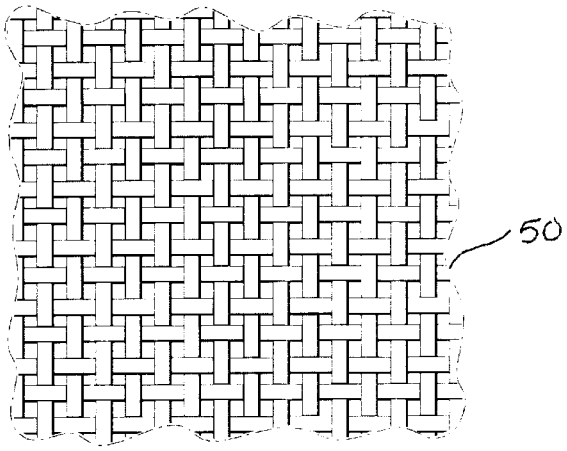
FIGS. 5 and 6 are plan views of preferred steel wire weave patterns of one of the layers of the invention.
Figure 6:
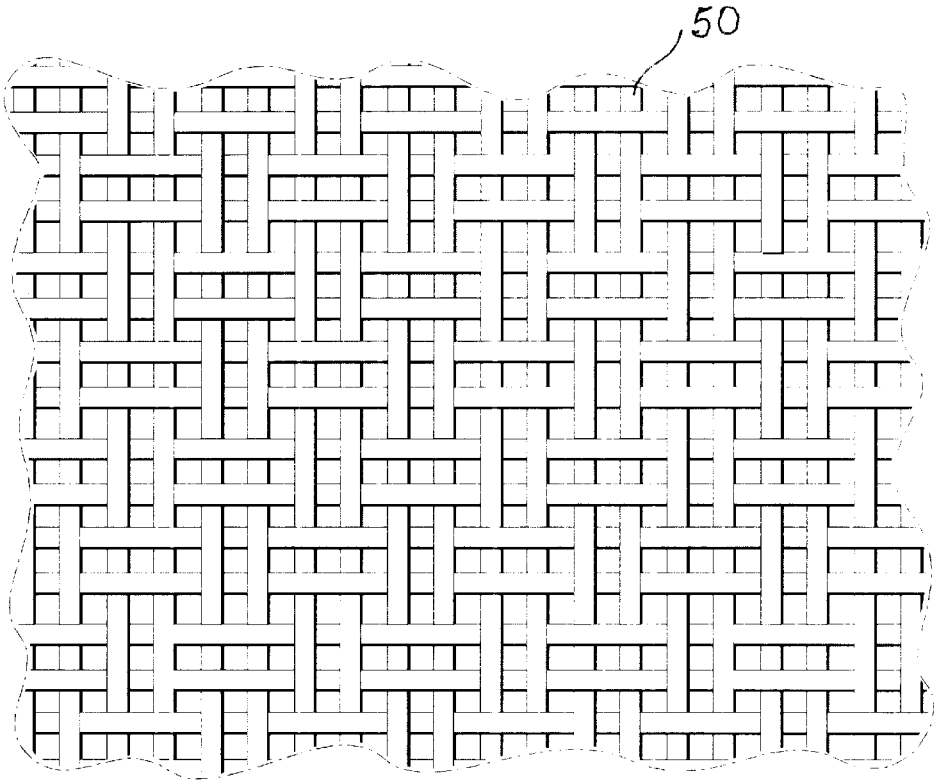

The composite plastic materials used in the construction of these laminated panels are well known chemical compositions specifically developed for high strength under impact loading, wherein the plastic tends to seal, while maintaining the elasticity required to counter impulse shock loading caused by the impact of a bullet or other projectile. Polyethylene resin, is used in the manufacture of the threads used and is similar or identical to those offered commercially as Spectra® and Kevlar®. Thread is used in weaving these materials in a selected pattern such as a plain weave, shown in FIG. 5, or a basket weave, as shown in FIG. 6. To achieve a maximum breaking strength of approx. 2,500 psi, the basket weave is used. The composite material fabric is used to form the outer shell 60 of the plate. The Epoxy 80 used in this application is of low viscosity to minimize weight, and it provides high strength while maintaining elasticity over a wide range of environmental temperatures.

The titanium alloy used in the construction of these plates is of a grade and type specifically developed for lightweight and high structural strength while maintaining the elasticity required to counter extreme shock loading. In order to achieve the desired properties the alloy is heat treated in an inert atmosphere, at a tightly controlled temperature. This is followed by a controlled cooling process. The precipitation temperature range is between 800 and 1150 degrees F. and is maintained at soak temperature for between 12 and 100 hours. A wider temperature range may be used with a different soak temperature time range. Prior to heat treating, the alloy must be carefully handled to avoid direct skin contact so that the metal will not be contaminated. Such titanium alloys and their methods of fabrication lo are well known in the art. The thickness of the titanium panels is in the range of from 1/8 to 7/16 inches in that it has been discovered through extensive testing that below 1/8 inches the panel is ineffective when used in conjunction with the other panels in the plate structure, and above 7/16 inches, the weight of the titanium panel is excessive for the marginal ballistic improvements gained. This is novel with respect to the prior art.

The material composition of the steel used in the present invention is of a type developed for high structural strength while maintaining the elasticity required to counter shock loading caused by a bullet or projectile impact. In order to achieve the desired properties the steel alloy is heat treated at a tightly controlled temperature followed by a controlled quench. The steel layer used in the present invention is an alloy normally used as armor plate for war vehicles and such, however, in this case it is rolled to a foil for use as one of the layers in certain of the panel configurations of this invention. When used as a panel alone, the steel panel is fabricated in a thickness up to 7/16 inches, but not exceeding this due to excessive weight for the modest marginal improvement that is gained in such heavier panels when used in conjunction with the composite structure of the present invention.

In the case of the wire mesh, the material chemical composition has been specifically developed for high structural strength while maintaining the elasticity required to counter shock loading caused by a bullet or projectile impact. In order to achieve the specific properties the steel alloy wire is drawn to a desired diameter and tensile strength. This is achieved by cold work hardening and normalizing at 375 degrees F. for 20–30 minutes prior to weaving the screen.

The individual layers 70 used to make the panels 50 of this invention are typically from 1/16 to 7/16 inches in thickness and may be fabricated down to 0.020 inches, i.e., a foil. The present invention distinguishes over the prior art by the discovery that such thin layers of the materials described, when bonded together in a composite structure, are able to perform equally as well or even out-perform the heavier and much more costly Kevlar and Spectra plates in common use. This is a remarkable finding for it enables improved personal protection at a low cost.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A ballistic protection apparatus comprising: a laminated assembly of a plurality of panels, each of the panels made up of layers, including in order, a foil layer of a tempered steel alloy, a layer of tightly woven threads of polyethylene resin formed using a basket weave, and a layer of a tempered wire mesh, the wire mesh cold work hardened and thereafter normalized at 375 F. for between 20 and 30 minutes, the steel, polyethylene and wire mesh layers each having a thickness of approximately 0.020 inches.

* * * * *